US005530537A

United States Patent [19]

Thayer

[11] Patent Number: 5,530,537

[45] Date of Patent: Jun. 25, 1996

[54] BIASED FOAM ROLL CLEANER

[75] Inventor: Bruce E. Thayer, Webster, N.Y.

[73] Assignee: Xerox Corporation, Stamford, Conn.

[21] Appl. No.: 306,285

[22] Filed: Sep. 15, 1994

[51] Int. Cl.[6] ..... G03G 21/00

[52] U.S. Cl. ..... 355/298; 15/1.51; 15/256.52; 355/296

[58] Field of Search ..... 355/296, 298; 118/652; 15/1.51, 256.5–256.52

[56] References Cited

U.S. PATENT DOCUMENTS

| | | | |
|---|---|---|---|
| 3,656,200 | 4/1972 | Riley, Jr. | 15/97.1 |
| 3,728,016 | 4/1973 | Harbour, Jr. et al. | 355/296 |
| 3,807,853 | 4/1974 | Hudson | 355/298 |
| 3,848,994 | 11/1974 | Fraser | 355/302 |
| 4,101,215 | 7/1978 | Fottner et al. | 15/256.52 X |
| 4,530,596 | 7/1985 | Kawamoto et al. | 15/256.52 X |
| 4,967,231 | 10/1990 | Hosoya et al. | 355/296 X |
| 5,148,227 | 9/1992 | Senba et al. | 355/296 |
| 5,349,426 | 9/1994 | Kudoh et al. | 355/298 |

FOREIGN PATENT DOCUMENTS

| | | | |
|---|---|---|---|
| 62-67578 | 3/1987 | Japan | 355/296 |
| 3-17678 | 1/1991 | Japan | 355/296 |
| 5-201120 | 8/1993 | Japan | 355/296 |

*Primary Examiner*—William J. Royer
*Attorney, Agent, or Firm*—T. L. Fair

[57] ABSTRACT

An apparatus for cleaning the imaging surface of an electrophotographic machine that includes a biased conductive foam roll. The biased conductive foam roll removes toner from the photoreceptor. The biased foam roll provides the electrostatic cleaning advantages of an electrostatic brush cleaner without the problem of toner accumulation in the brush. The cell structure of the foam roll limits toner accumulation to close to the cleaning surface to enable simple detoning of the foam roll cleaner by a biased detoning roll or air flow.

24 Claims, 2 Drawing Sheets

BIASED FOAM ROLL CLEANER

BACKGROUND OF THE INVENTION

This invention relates generally to a cleaning apparatus in an electrostatographic machine, and more particularly concerns a foam roll cleaner.

Foam roll cleaners have been used in the past to clean photoreceptor surfaces, because of their low abrasion against the photoreceptor surface, by bringing the foam roll into interfering contact with the photoreceptor and rotating the foam roll against the direction of photoreceptor motion. Toner cleaned by the foam roll is then removed by the action of a flicker bar interfering with the foam roll and an air flow to remove the dislodged particles from the cleaner. However, the foam roll cleaners presently used have limited control in changing environments (e.g. humidity and surface triboelectric conditions).

Electrostatic brush cleaners have advantages over mechanical brush cleaners in that the electrostatic forces used to remove toner from the photoreceptor are much more controlled and predictable, e.g., with respect to environmental conditions. However, one major problem with electrostatic brush cleaners, is that they accumulate toner deep within the brush fibers where the normal detoning methods cannot remove it. This toner accumulation does not normally result in a direct loss of photoreceptor cleaning, but rather in the creation of large spot defects on the copy due to toner dropping or falling from the brush fibers. Another problem with toner accumulation is that toner can accumulate to such an extent that the brush becomes hard and causes mechanical failures. This problem of toner accumulation has resulted in additional detoning devices, in conjunction with the initial detoning devices, being added to electrostatic brush cleaners. Such additional detoning devices for electrostatic brush cleaners include: air detoning to extract more of the toner from the brush cleaner than the original detoning rolls can remove or vacuuming of the electrostatic brushes by technical representatives at regular intervals to avoid excessive toner accumulation.

The following disclosures may be relevant to various aspects of the present invention and may be briefly summarized as follows:

U.S. Pat. No. 3,848,994 to Fraser discloses an electrostatographic system in which dry imaging toner is cleaned from a photoreceptor surface by a soft cleaning member, and the cleaning member in turn is electrostatically cleaned by a secondary or pick-off roller having a multiplicity of closely adjacent and differently charged conductors, which attract toner particles of either polarity and also uncharged toner.

U.S. Pat. No. 3,807,853 to Hudson discloses an apparatus for cleaning electrostatographic imaging surfaces. A cleaning device in the form of a roller that includes a non-conductive cellular surfaced material suitable for removal of marking material from an imaging surface. The roller surface is positioned with its long axis transverse to the direction of movement of the imaging surface and transported over an area of sweeping engagement with the imaging surface. The outer surface of the roller has a plurality of open cells which entrap the excess material on the imaging surface during the sweeping engagement thereof. After engagement, the roller is brought into proximity with a removal device for removing marking material from the surface cells.

U.S. Pat. No. 3,728,016 to Harbour, Jr. et al. discloses a cleaning apparatus for cleaning the residual toner image from an electrostatic plate of an electrostatic reproduction apparatus incorporates an open celled foam wiper which is mounted for wiping engagement with the plate. The foam wiper is mounted adjacent a conductor which is biased to attract charged toner particles to the wiper as the toner image moves relative therepast. The wiper is periodically cleaned by a serrated or grooved portion of the plate which follows the image and mechanically dislodges toner from the wiper. A reverse bias is applied to the conductor as the serrations on the plate move past the wiper creating a field between the wiper and the plate which repels toner from the wiper to the plate. The toner is carried by the serrations on the plate to the developer unit for use by the electrostatic reproduction apparatus.

U.S. Pat. No. 3,656,200 to Riley, Jr. discloses an improved cleaning mechanism for removing contaminants from generally non-porous surfaces. A sponge-like member surrounds a hollow perforated core. Sprayers, internal to the core, spray liquids under pressure to aid in removing contaminants from the sponge-like member against the core at a position where an internal baffle strip contacts the core. This seals the squeezed sponge-like member at the core preventing liquids and contaminants from passing the seal barrier formed.

SUMMARY OF INVENTION

Briefly stated, and in accordance with one aspect of the present invention, there is provided an apparatus for cleaning a surface. The apparatus comprises: a conductive porous member, contacting the surface, for removing particles therefrom; an electrical biasing device, coupled to the member, for applying an electrical field to the member to attract particles from the surface to the member; and means for removing particles from the member.

Pursuant to another aspect of the present invention, there is provided a printing machine of the type in which particles are removed from a photoconductive surface. The printing machine comprises: a conductive porous member, contacting the surface, for removing particles therefrom; an electrical biasing device, coupled to the member, for applying an electrical field to the member to attract particles from the surface to the member; and means for removing particles from the member.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 3:
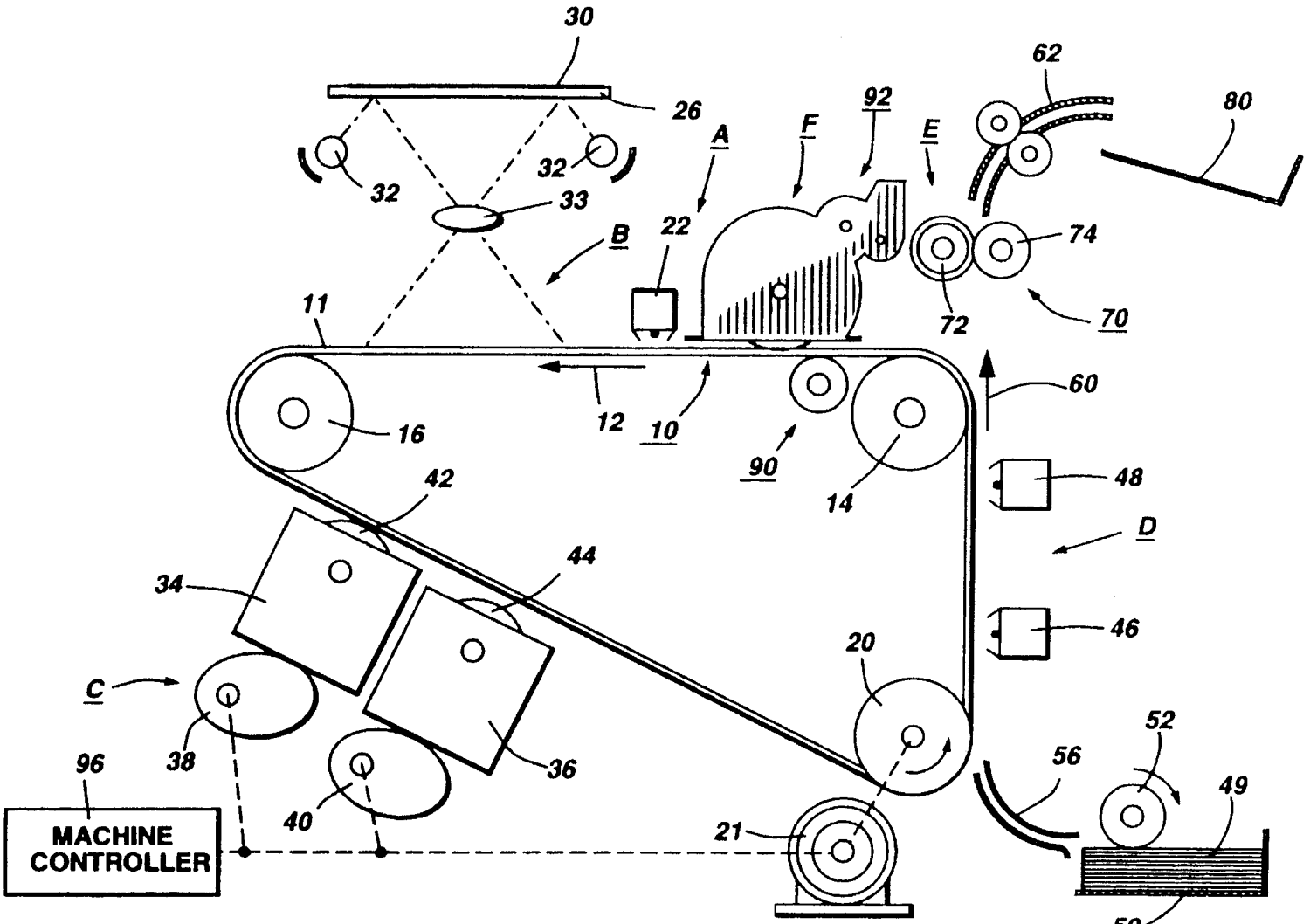
FIG. 3 is a schematic illustration of a printing apparatus incorporating the inventive features of the present invention.

For a general understanding of an electrophotographic printer or copier in which the present invention may be incorporated, reference is made to FIG. 3, which depicts schematically the various components, thereof. Hereinafter, like reference numerals will be employed throughout to designate identical elements. Although the biased foam roll cleaner apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 3, will be described briefly hereinafter. It will no doubt be appreciated that the various processing elements also find advantageous use in electrophotographic printing applications from an electronically stored original, and with appropriate modifications, deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 3, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92 which will be described in greater detail in FIG. 2. Removed residual particles may also be stored for disposal. A backup roll 90 is provided as support to the photoreceptor belt 10 during the cleaning phase of the xerographic process.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

As thus described, a reproduction machine, in accordance with the present invention may be any of several well known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein.

Figure 1:
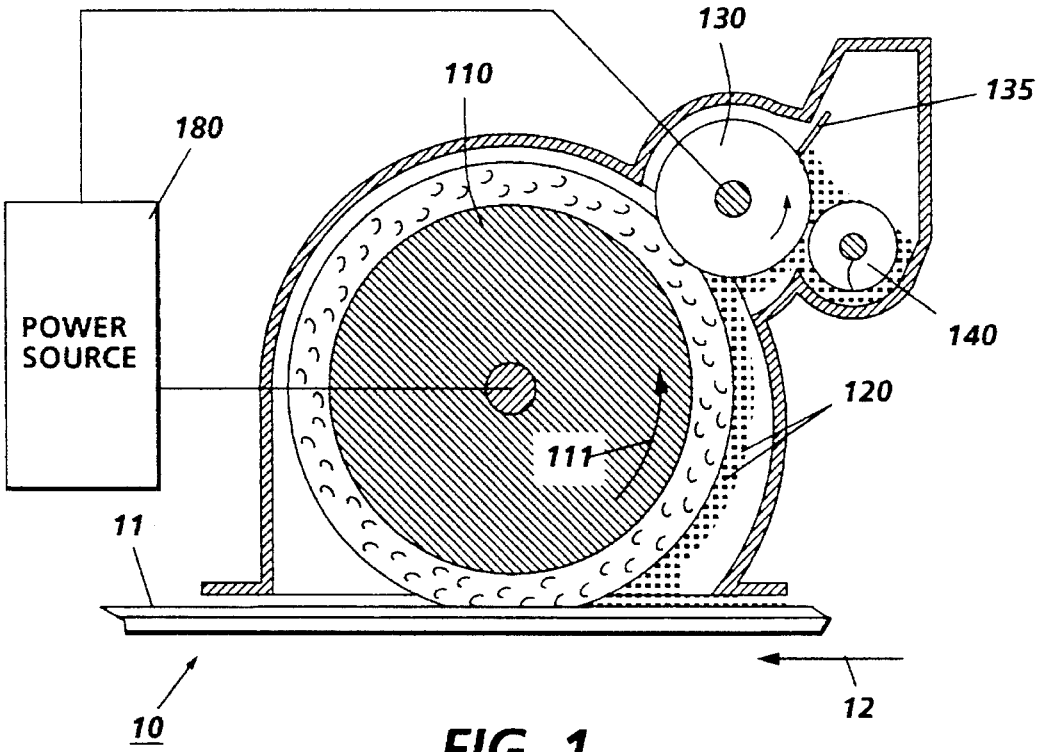
FIG. 1 is an elevational view of the present invention showing a biased conductive foam roll cleaner with a detoning roll.

Referring now to FIG. 1, the present invention uses a biased, conductive foam roll 110 to remove toner 120 from the photoreceptor 10. The foam roll 110 is made from a flexible cellular material that includes: polyurethane (e.g. polyurethane-polyether, polyurethane-polyester); polychloroprene; elastomer silicone expanded rubber or elastomer; and the combination of polyurethane-polyether and polyester copolymer and foamed polyvinyl alcohol. A bias is applied to the foam roll 110 to provide better control removing toner 120 from the photoreceptor 10, with respect to environmental conditions, as is the case with electrostatic brushes mentioned above. A power source 180 provides the electrical bias to the foam roll 110 and the detoning roll 130. The bias applied to the foam roll 110 ranges from approximately −50 V to −350 V. The bias applied to the detoning roll 130 is biased above the bias of the foam roll by a value of −50 V to −350 V, respectively. The biased foam roll 110 has the electrostatic cleaning advantages of an electrostatic brush cleaner without the problem of toner accumulation in the brush. This is due to the cell structure of the foam roll 110 which confines toner accumulation to near the cleaning surface enabling efficient detoning through simple detoning, rather than accumulating toner deep in the cleaner brush fibers preventing toner removal from the fibers by normal detoning means. The detoning of a foam roll cleaner 110 can be accomplished with a biased detoning roll 130 or air flow (see FIG. 2). The detoning roll 130, rotating in a counter clockwise position, is cleaned by a scraper blade 135. The toner and debris particles removed from the detoning roll 130 by the scraper blade 135 fall toward an auger 140 which transports the toner and debris particles away from the cleaner.

With continued reference to FIG. 1, the biased foam roll 110 is brought into interfering contact with the photoreceptor 10. The biased foam roll 110 rotates, in the direction of arrow 111, as it contacts the surface of the photoreceptor 10 moving in a direction, shown by arrow 12. The foam roll 110 moves in an "against" direction to the motion of the photoreceptor 10. The foam roll provides very low abrasion against the photoreceptor.

Figure 2:
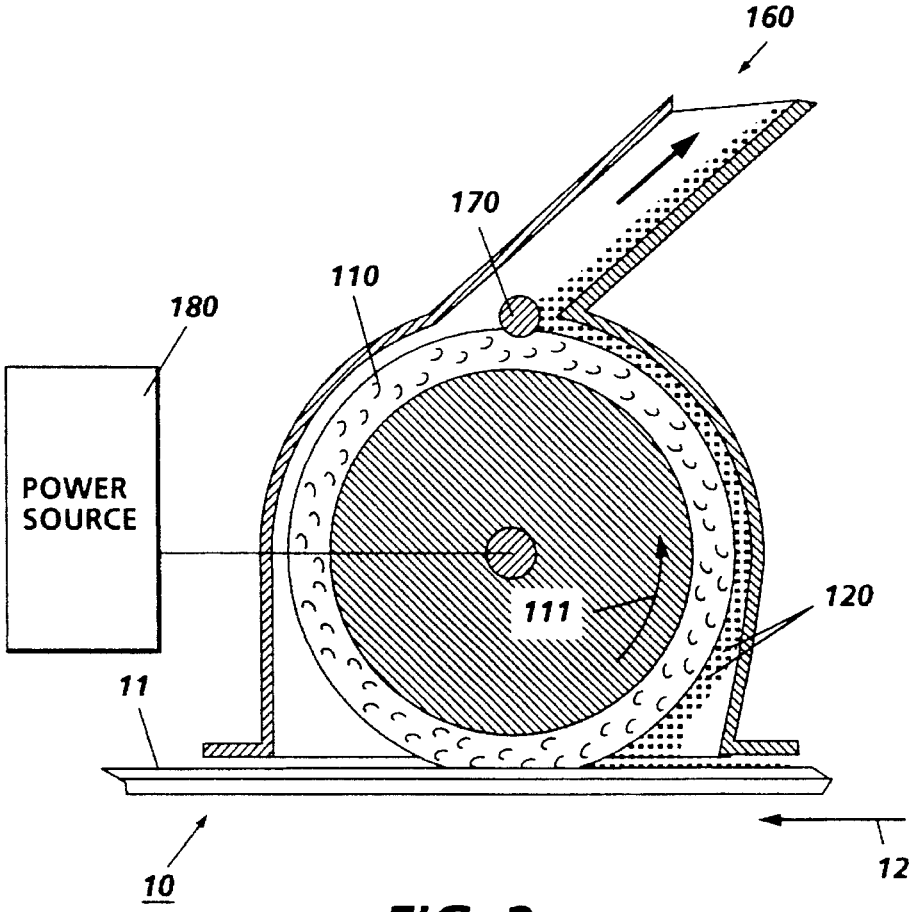
FIG. 2 is an elevational view of another embodiment of the present invention showing the biased conductive foam roll cleaner with air detoning.

Reference is now made to FIG. 2, which shows an elevational view, of another embodiment, of the present invention showing air detoning of the foam roll cleaner 110. As described above in FIG. 1, the foam roll was brought into interfering contact with the photoreceptor 10 and rotated against the direction of photoreceptor 10 motion, shown by arrow 12. The toner cleaned from the photoreceptor 10 by the foam roll 110 is then removed by the action of a flicker bar 170 interfering with the foam roll 110 and air flow 160 removes the dislodged particles from the foam roll cleaner 110.

In the present invention, the biased conductive foam roll cleaner performs the photoreceptor cleaning function as well as an electrostatic brush cleaner. The texture of the interfering foam roll approximates the brush fiber tips of an electrostatic brush. The foam roll pores passing through the cleaning nip can be correlated to the fiber strikes through the cleaning nip of the electrostatic brush cleaner.

In the present invention, the electrostatic brush cleaner replaces the brush with a biased conductive foam roll to eliminate the problem of excessive toner accumulation. The cell structure of the foam surface would inhibit the migration of large quantities of toner into the interior of the roll. With the toner remaining at or near to the surface of the roll the probability of successfully removing this toner by normal detoning means is greatly increased. Additionally, since the toner does not travel through the foam nearly as easily as through a brush, any toner which might migrate into the interior of the foam roll would be much less likely to fall from the biased conductive foam roll creating the spot defects that occur from the residual toner falling from brushes. In fact, if the migration out of the foam roll is slow enough, it is possible that much of the toner will be detoned from the roll before any noticeable copy defects occur.

The nature of the foam cell structure can be modified to enhance the cleaning function and minimize toner accumulation. The pore density (e.g. ~50 to ~500 pores/in. for ~0.5 mm pore size to ~50 μm pore size, respectively) and proportion of open and closed cells in the foam will affect the mechanical properties of the roll. They also affect the number of contacts of the roll to the toner in passing through the nip and the ease at which toner passes through the cellular matrix. It is also possible to form the foam roll with a skin on the surface by processing the roll within a mold the diameter of the roll. This skin would totally eliminate the problem of toner accumulation within the roll, but the cleaning performance of the skin may not be as successful as an exposed cellular surface. Through careful processing it may be possible to manufacture a foam roll of substantially closed cells and then open only the cells on the surface of the roll. This would result in many cleaning contacts from the open cells at the surface which could be detoned and yet would prohibit the migration of toner any deeper into the roll.

The major benefit of a biased conductive foam roll over an electrostatic brush cleaner is in the elimination of the spot defects resulting from toner embedded in the brush falling on the photoreceptor. Another benefit of the biased conductive foam roll over the brush cleaner is the elimination of brush set failure mode due to fiber entanglement which results in a decrease in service cost. Additionally, the far less complicated manufacturing process of foam rolls provides a larger supplier base than available for electrostatic brushes.

In recapitulation, the present invention provides an apparatus for cleaning the imaging surface of an electrophotographic machine that includes a biased conductive foam roll. The biased conductive foam roll removes toner from the imaging surface (i.e. photoreceptor). The biased foam roll has the electrostatic cleaning advantages of an electrostatic brush cleaner without the problem of toner accumulation in the brush. The cell structure of the foam roll limits toner accumulation near the cleaning surface enabling efficient detoning of the foam roll, unlike a brush cleaner that allows toner to accumulate deep in the brush fibers preventing removal of the accumulated toner via normal detoning means. The detoning of a foam roll cleaner can be accomplished with a biased detoning roll or air flow.

It is, therefore, apparent that there has been provided in accordance with the present invention, a biased conductive foam roll that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning a surface, comprising:

a conductive porous member, contacting the surface, for removing particles therefrom, said member comprising a core having a single porous layer about said core;

an electrical biasing device, coupled to said member, for applying an electrical field to said member to attract particles from the surface to said member; and means for removing particles from said member.

2. An apparatus as recited in claim 1, wherein said removing means comprises an electrically biased detoning roll adjacent said member to attract particles from said member thereto.

3. An apparatus as recited in claim 2, further comprising a scraper in contact with said detoning roll to remove particles therefrom.

4. An apparatus as recited in claim 2, wherein said member comprises a foam roll.

5. An apparatus as recited in claim 4, wherein said foam roll is selected from a group of materials consisting of polyurethane, polychloroprene, polyvinyl alcohol, and elastomer silicone expanded rubber.

6. An apparatus as recited in claim 4, wherein said foam roll comprises an interior structure and a porous structure disposed in said interior structure, said porous structure being substantially impervious to migration of substantial quantities of particles into said interior structure.

7. An apparatus as recited in claim 4, wherein said foam roll rotatingly contacts the surface to remove particles therefrom.

8. An apparatus as recited in claim 1, wherein said removing means comprises vacuum means for creating air flow along said member to remove particles therefrom.

9. An apparatus as recited in claim 8, wherein said member comprises a foam roll.

10. An apparatus as recited in claim 9, wherein said foam roll is selected from a group of materials consisting of polyurethane, polychloroprene, polyvinyl alcohol, and elastomer silicone expanded rubber.

11. An apparatus as recited in claim 9, wherein said foam roll comprises an interior structure and a porous structure disposed in said interior structure, said porous structure being substantially impervious to migration of substantial quantities of particles into said interior structure.

12. An apparatus as recited in claim 9, wherein said foam roll rotatingly contacts the surface to remove particles therefrom.

13. A printing machine of the type in which particles are removed from a photoconductive surface, comprising:

a conductive porous member, contacting the surface, for removing particles therefrom, said member comprising a core having a single porous layer about said core;

an electrical biasing device, coupled to said member, for applying an electrical field to said member to attract particles from the surface to said member; and means for removing particles from said member.

14. A printing machine as recited in claim 13, wherein said removing means comprises an electrically biased detoning roll adjacent said member to attract particles from said member thereto.

15. A printing machine as recited in claim 14, further comprising a scraper in contact with said detoning roll to remove particles therefrom.

16. A printing machine as recited in claim 14, wherein said member comprises a foam roll.

17. A printing machine as recited in claim 16, wherein said foam roll is selected from a group of materials consisting of polyurethane, polychloroprene, polyvinyl alcohol, and elastomer silicone expanded rubber.

18. A printing machine as recited in claim 16, wherein said foam roll comprises an interior structure and a porous structure disposed in said interior structure, said porous structure being substantially impervious to migration of substantial quantities of particles into said interior structure.

19. A printing machine as recited in claim 16, wherein said foam roll rotatingly contacts the surface to remove particles therefrom.

20. A printing machine as recited in claim 13, wherein said removing means comprises vacuum means for creating air flow along said member to remove particles therefrom, the particles being transported away from said member.

21. A printing machine as recited in claim 20, wherein said member comprises a foam roll.

22. A printing machine as recited in claim 21, wherein said foam roll is selected from a group of materials consisting of polyurethane, polychloroprene, polyvinyl alcohol, and elastomer silicone expanded rubber.

23. A printing machine as recited in claim 21, wherein said foam roll comprises an interior structure and a porous structure disposed in said interior structure, said porous structure being substantially impervious to migration of substantial quantities of particles into said interior structure.

24. A printing machine as recited in claim 21, wherein said foam roll rotatingly contacts the surface to remove particles therefrom.

* * * * *